US005245936A

United States Patent [19]

Nakata

[11] Patent Number: 5,245,936

[45] Date of Patent: Sep. 21, 1993

[54] INCINERATOR

[76] Inventor: Susumu Nakata, 3-18-21 Nishinakajima Yodogawaku, Osaka City, Osaka, Japan

[21] Appl. No.: 942,462

[22] Filed: Sep. 9, 1992

[30] Foreign Application Priority Data

Feb. 21, 1992 [JP] Japan ..... 4-72579

[51] Int. Cl.[5] ..... F23G 51/00

[52] U.S. Cl. ..... 110/251; 110/203; 110/235; 110/297

[58] Field of Search ..... 110/235, 251, 297, 233, 110/314, 203, 216

[56] References Cited

U.S. PATENT DOCUMENTS 4,823,710 4/1989 Garrido et al. ..... 110/297 X

FOREIGN PATENT DOCUMENTS 4375 1/1974 Japan .

3-30670 6/1991 Japan .

*Primary Examiner*—Edward G. Favors

*Attorney, Agent, or Firm*—Evenson, McKeown, Edwards & Lenahan

[57] ABSTRACT

An incinerator of sectional structure has an airpipe for sending combustion air into a furnace. The airpipe is a straight pipe tapered off at end portion and closed by a plug of castable refractory material filled up in the tapered portion to improve the durability under high temperature circumstances. The airpipe is also inserted into a furnace through a hole opened on an upper furnace wall, and a seal member of easy spallable and castable refractory material fills up the gap between the airpipe and the hole to make easy exchange of the airpipe possible.

12 Claims, 4 Drawing Sheets

INCINERATOR

BACKGROUND OF THE INVENTION

The present invention relates to an incinerator having an airpipe for inducting combustion air into a furnace, especially a furnace having a sectional structure comprising an injection block, a flue block and an intermediate block inserted between the above two blocks according to the required furnace capacity.

It is known that each block of the sectional structure has an airpipe. Each airpipe may uniformly provide combustion air into the furnace. The capacity of the furnace can be increased by adding or changing the intermediate block. Providing uniform air to the furnace produces less harmful gas because of the efficient combustion. The sectional structure may also easily provide for several kinds of incinerators having different burning capacities by changing the pipe connections and the blowing power from the exterior of the furnace.

Each block of the sectional structure also has a steel outer wall coated with an inner refractory lining layer, ensuring long, safe operation. Still, a steel airpipe will be easily worn out by oxidation by being subjected to a constant high temperature. The tip portion close to an end wall suffers more severe losses than other portions of the airpipe. The combustion air's cooling is not sufficient for the tip portion and cracks at the pipe end caused by welding the end wall induce the oxidation. Finally, the end portion of the airpipe drops off the end wall and opens a straight path that prevents the uniform jet of combustion air through the airpipe and forces replacement of the whole airpipe.

The airpipe is also directly coated with the refractory lining of the outer wall. Therefore, the replacement of the airpipe requires very laborious work to break the strong refractory layer.

A blower for the airpipe will suspend operation immediately after an access door begins to open. Stopping the blower acts to suppress the flame from shooting out the refuse access port by stopping the supply of pressurized air into the furnace through the airpipe. Still, there is a small unavoidable time lag before the pressure in the furnace drops to atmospheric level after starting to open the door. Therefore, an operator in front of the access port cannot work safely because of the possibility of the flame shooting through the opening.

BRIEF SUMMARY OF THE INVENTION

An object of the present invention is to provide a durable airpipe with a relatively long interval for replacement by improving the closed structure of the end portion.

A further object of the present invention is to provide a new structure for replacing the airpipe by improving the interface of the airpipe to the outer wall.

Another object of the present invention is to provide a new structure for safely supplying additional injection by improving the supplying method of combustion air when the access door begins to open.

According to the present invention, an incinerator has a furnace for incinerating refuse, an exhauster for drawing out waste gas from the furnace and a device for supplying air into the furnace, the furnace further including:

a first block for injecting refuse into the furnace through an access port closed by a door, a second block for leading combustion gas to the exhauster through a flue hole, a third block inserted between the first and the second block according to the required furnace capacity, and an airpipe for blowing combustion air into each of the blocks from the air supplying device, the airpipe being a straight pipe of stainless steel having a plurality of injection holes around the pipe surface and a plug of castable refractory for closing an opening of the pipe end.

In especially preferred embodiments of the present invention, each of the furnace blocks has a steel external wall, a heat resisting and insulating layer lined on the external wall and a refractory layer coated on the inmost face of the external wall, a hole on the furnace wall for inserting the airpipe into the furnace interior, and a castable and easy spallable refractory member for filling up a gap between the hole and the airpipe.

A preferred embodiment of the invention further provides an exhauster having a dust collector connected to the second block of the furnace, a chimney for drawing out exhausted gas, and an air ejector placed between the dust collector and the chimney. Further, the air supplying device includes a blast fan for providing air to the airpipe through a damper of a blast path connected to the fan, and a branch pipe separated from the damper and extended into the air ejector. The damper distributes air to the branch pipe shortly upstream of an opening of the injection hole.

Other objects, advantages and novel features of the present invention will become apparent from the following detailed description of the invention when considered in conjunction with the accompanying drawings.

DETAILED DESCRIPTION OF THE DRAWINGS

Figure 1:
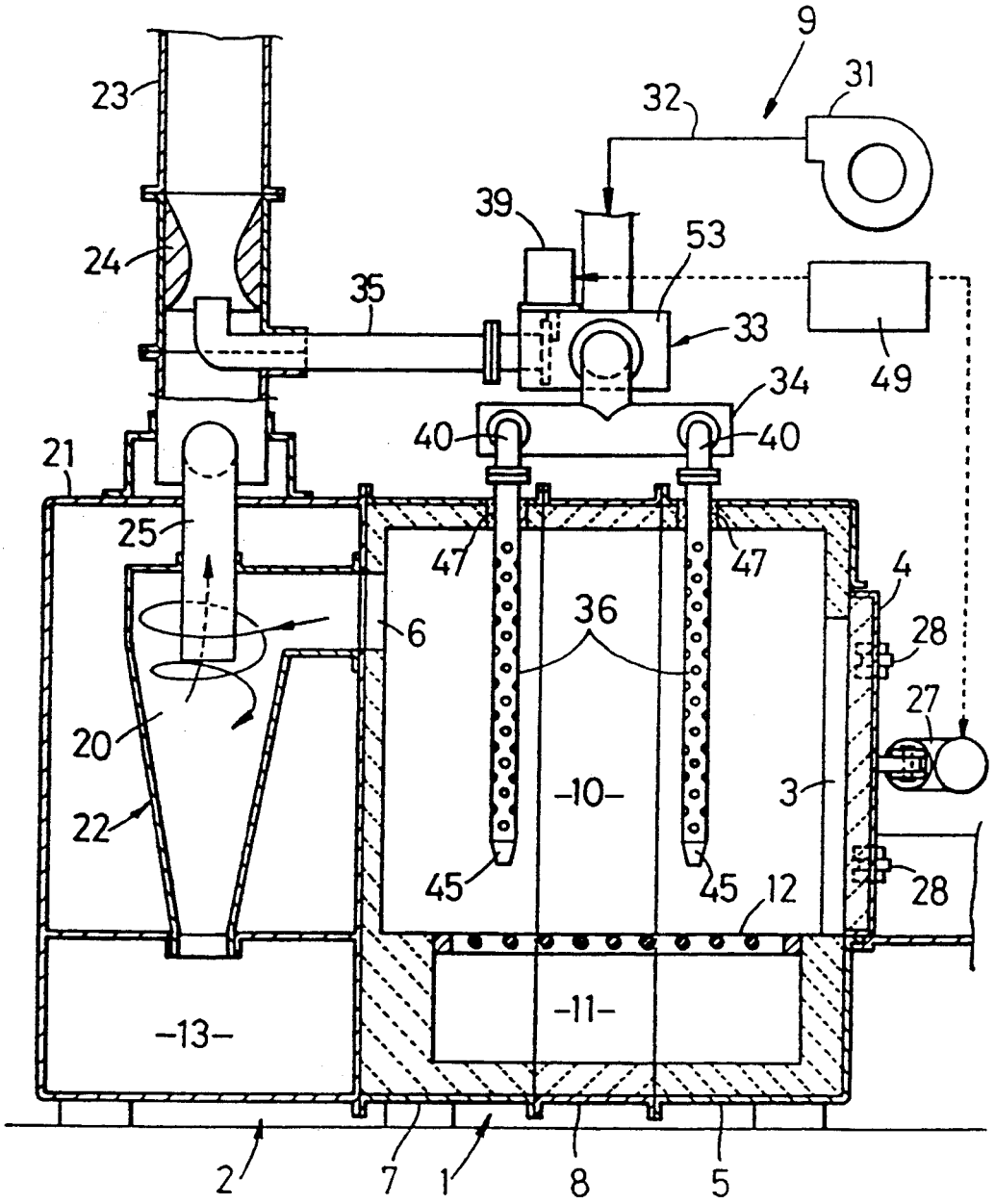
FIG. 1 is a cross sectional side view of an incinerator constructed according to a preferred embodiment of the invention.
Figure 2:
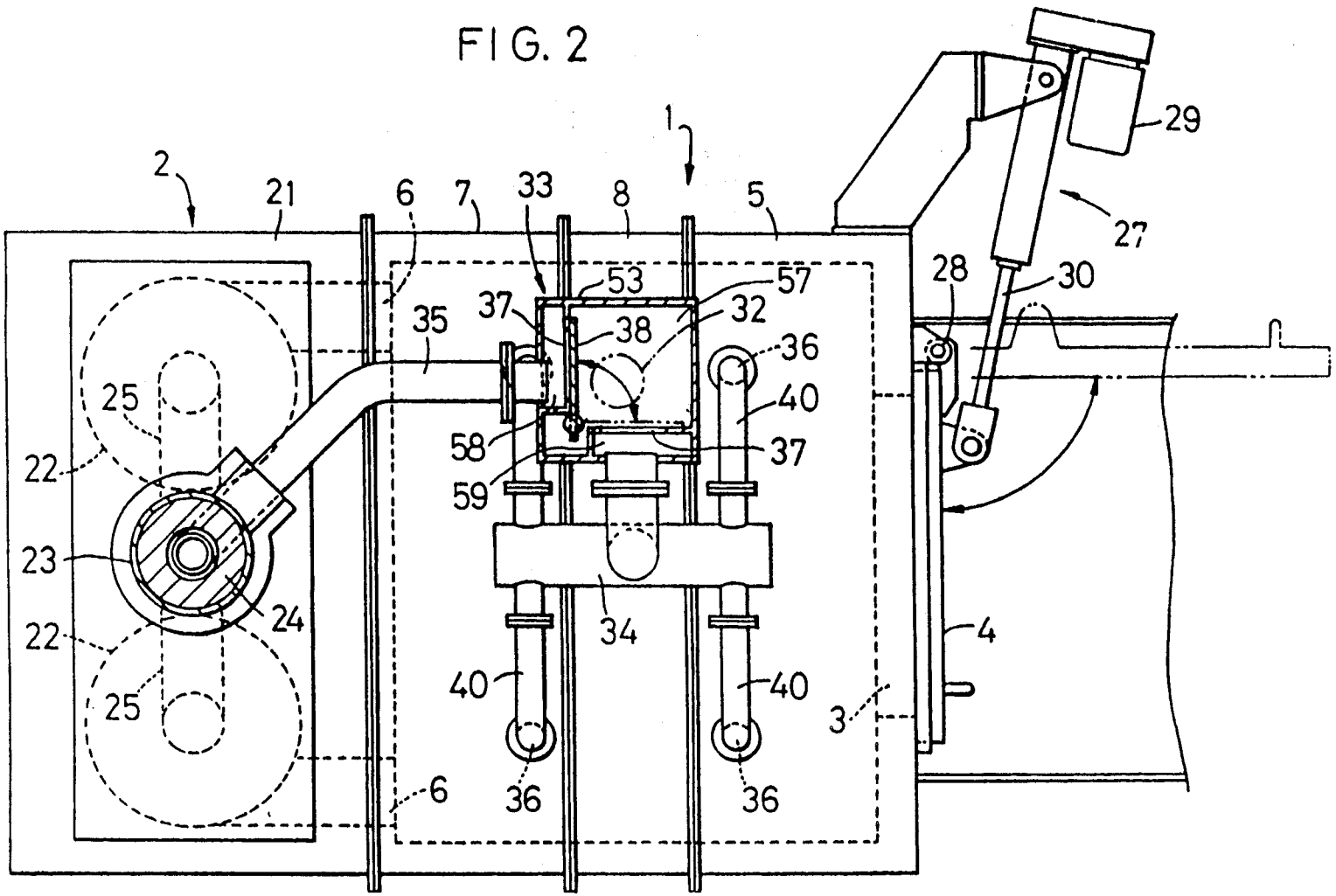
FIG. 2 is a plan, part sectional view of the incinerator of FIG. 1.

An incinerator constructed according to an embodiment of the present invention, as illustrated in FIGS. 1 and 2, comprises a furnace 1, an exhauster 2 and an air supplying device 9. The furnace 1 has an injection block 5 having an access port 3 and an access door 4, a flue block 7 having two flue holes 6,6 and an intermediate block 8 inserted between the blocks 5 and 7. The three blocks 5, 7 and 8 comprise a combustion chamber 10 and an ash chamber 11 partitioned by a fire grate 12.

Figure 3:
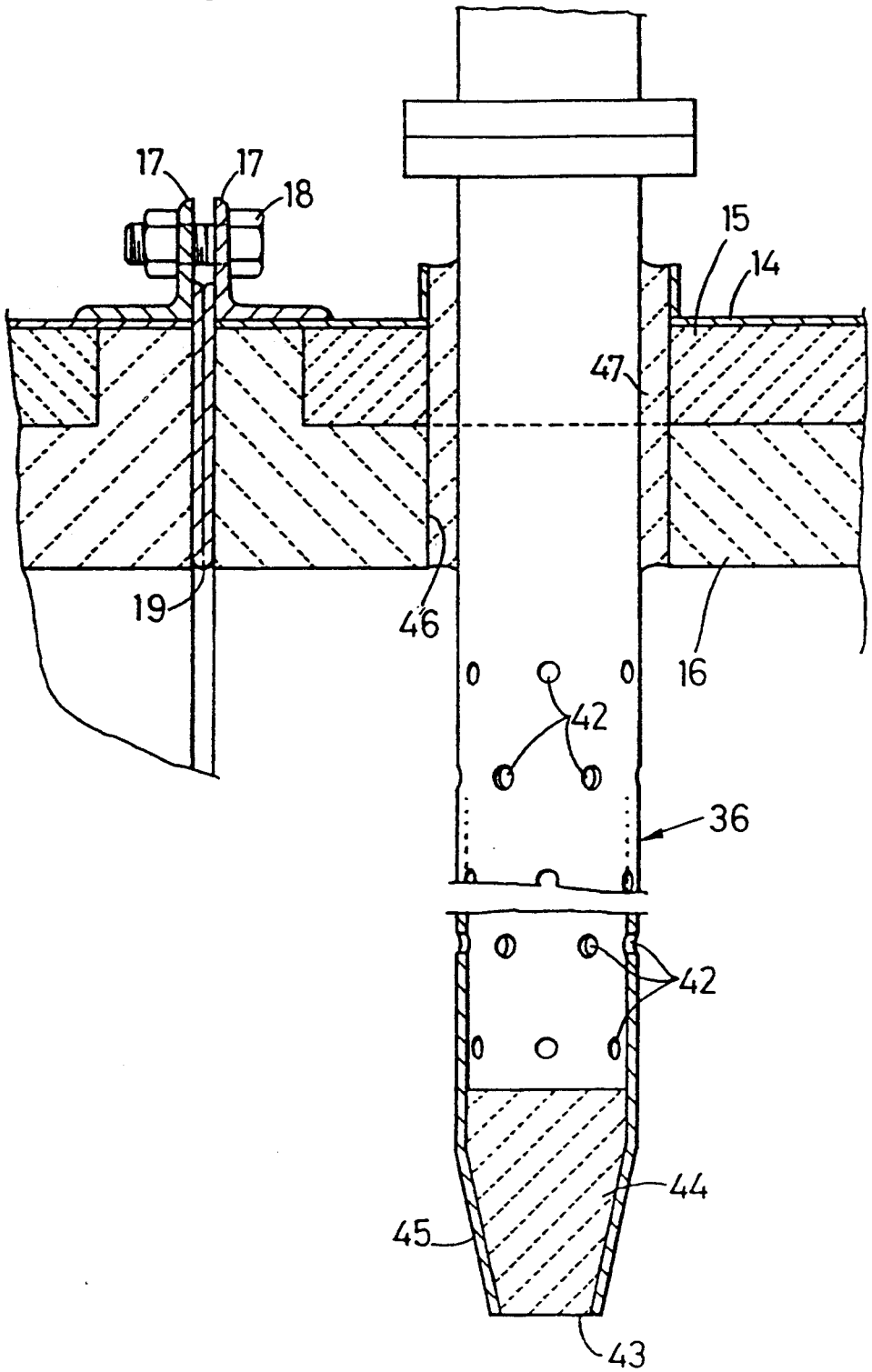
FIG. 3 is an enlarged sectional view showing detail structure of an airpipe of the embodiment of FIGS. 1–3.

The furnace wall of each block 5, 7 and 8, as shown in FIG. 3, comprises a steel external wall 14, a heat resisting and insulating layer 15 and a refractory lining layer 16 coated on the inmost face. Each junction face between each block 5,7,8 contacts with the refractory lining layer 16 extended inwardly. The heat resistant and insulating layer 15 is a silica board that is 4 inches (100 mm) thick and is coated by the refractory lining layer 16 which is a castable refractory that is 6 inches (150 mm) thick.

The above blocks 5, 7 and 8 are connected at a flange 17 by bolts 18 as one body. The junction part has a gasket 19 between the contacting faces for sealing. The gasket 19 is a folded over ceramic fiber sheet.

The exhauster 2 has a case 21 connected to the flue block 7, a pair of dust collectors 22 of cyclone type placed in the case 21, a chimney 23 extended from the top of the case 21, and an air ejector 24 placed under the chimney 23. The dust collector 22 has entrances connected to the front and rear flue holes 6. The collector 22 also has a centrifugal chamber 20 in the center connected to the chimney 23 through a gas duct 25. The dust separated in the dust collector 22 falls into a dust chamber 13.

In FIG. 2, the access door 4 of the injection block 5 opens or closes rotating around a hinge 28 by a piston 27. The piston 27 sets an operating lever 30 in and out in cooperation with a screw bolt engaged in a driving nut rotated by a motor 29. The piston 27 is suitable for opening and closing the access door 4 because the operating lever 30 moves at constant speed that is slower than a conventional fluid pressure cylinder.

The apparatus 9 for supplying combustion air into the furnace 1 comprises a motor(not shown), a blast fan 31 driven by the motor, a blast path 32 extending from the outlet of the fan 31, a damper 33 placed above the upper face of the furnace 1, and a distributing pipe 34 and a branch pipe 35 extend from the damper 33. Also, an airpipe is provided for the injection block 5 and the flue block 7.

The damper 33, which is constructed in a box 53 above the furnace 1, has an entrance chamber 57 connected to the airpipe and two exit chambers 58,59 connected to the airpipe 36 or to the branch pipe 35. The entrance chamber 57 is connected to each of the exit chambers 58, 59 through a hole 37, which is opened or closed alternatively by a valve plate 38 to transmit combustion air into the distributing pipe 34 or the branch pipe 35. A rotary solenoid 39, attached on the box 53, controls the position of the valve plate 38. Also an intermediate pipe 40 of elbow type connects the distributing pipe 34 and the airpipe 36 with each other. The leading end of the branch pipe 35 is placed in the air ejector 24 from the bottom.

In FIG. 3, the airpipe 36 is a straight pipe of stainless steel. The pipe has a plurality of injection holes 42 around the surface and a plug 44 closing the opening 43 of the lower end. The plug 44 comprises a castable refractory material that is the same material as that of the refractory lining layer 16. The airpipe 36 also has a plug holder 45 provided by tapering off the pipe end to the bottom to maintain the position of the plug 44 over an extended period. The plug 44 is made by filling up the plug holder 45 with the castable refractory material which is then dried up to harden.

The airpipe 36 is inserted into the furnace interior through a hole 46 opening on the upper furnace wall which is larger than the diameter of the airpipe 36. An easy spallable seal member 47 and castable refractory material fills up the gap between the airpipe 36 and the hole 46. The construction steps of the seal member 47 are almost the same as described above for the plug 44. The castable refractory material, such as "fibercaster", is suitable for the seal member 47 because the material can spall and be removed more easily than the lining layer 16 while replacing the airpipe 36.

The operation of the incinerator starts by placing some refuse into the furnace through the access port 3. After closing the access door 4, combustion air spouts through the airpipe 36 and burns the refuse. The combustion gas produced from the burning runs into the collector 22 through the flue hole 6. The collector 22 separates the dust from the waste gas, which flows into the chimney 23 through the gas duct 25. The pressure in the furnace is a little higher than the atmospheric level because the air pressure during the burning in the airpipe 36 is about 150 mm $H_2O$. Therefore, opening of the access door 4 during operation would cause a flame jet and combustion gas to shoot out from the access port 3. A controller 49, provided on the outside of the furnace, controls the damper 33 and the power cylinder 27 so as to prevent such danger.

The controller 49 has start and stop switches for the blast fan 31, open and close switches for the access door 4 and other control circuits. Actuating the open switch for the access door 4 supplies driving current to the rotary solenoid 39 in order to change the position of the valve plate 38 to a side shown by a partly dashed line in FIG. 2. Therefore, all the combustion air running into the furnace 1 changes the direction to the air ejector 24. The blast fan 31 is suspended and the air ejector 24 absorbs the combustion gas from the furnace 1 through the dust collector 22 and decreases the pressure in the furnace 1.

After the pressure in the furnace 1 decreases (a timer in the controller 19 counts a certain period after turning on the open switch of the access door 4), the controller 49 supplies driving current to the motor 29 of the power cylinder 27. By this operation, the access door 4 slowly opens to the position shown by the partly dashed line in FIG. 2. The flame and the combustion gas will not shoot out of the access port 3 because the pressure in the furnace 1 has become lower than the atmospheric level at the beginning of the access door open operation. Therefore, an operator can safely add more refuse.

When the operator turns on the close switch of the access door 4, the power cylinder 27 initially moves to the close position. Then, the rotary solenoid 39 changes the position of the valve plate 3 to supply combustion air in the furnace 1 through the airpipe 36.

Variations and modifications may be made in respect of the above described embodiment without departing from the scope of the invention. For example, it is possible to stop the valve plate 38 near the hole 37 to distribute the combustion air to the branch pipe 35 and the airpipe 36 simultaneously. In this case, the distributed air to the branch pipe 35 will decrease the temperature of the exhaust gas in the chimney 23 during the operation and the distributed air to the airpipe 36 will depress the production of harmful gas in the furnace 1 when more refuse is added.

It is also possible to open the access door 4 by hand. In this case, a lamp for displaying danger or safety of the door open and a switch operated prior to opening are required for protecting an operator from being burned.

When the switch is turned on, the pressure in the furnace falls down below the atmospheric pressure at first, then the lamp indicates that it is safe to open the access door 4.

Figure 4:
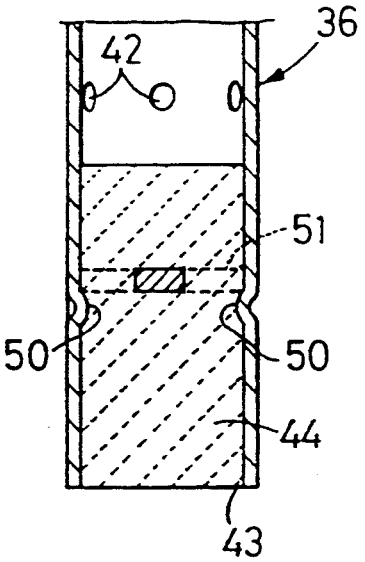
FIGS. 4 and 5 are sectional views showing other airpipe embodiments.
Figure 5:
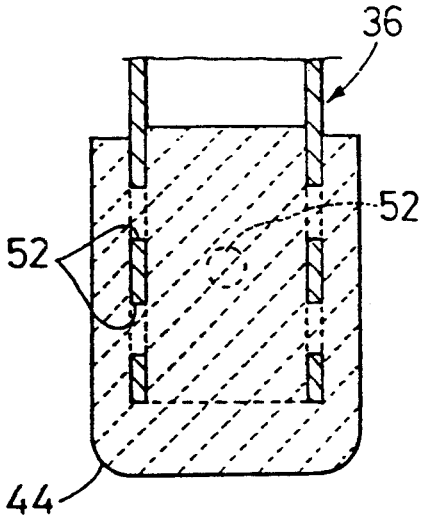

FIGS. 4 and 5 show another embodiment of the closing structure of the airpipe 36. In FIG. 4, the airpipe 36 has a plurality of detents 50 directed inwardly o the inner wall and the detents 50 support a plate 51 included in the plug 44. In FIG. 5, the castable refractory encloses the external surface connected to the inner part through a plural of holes 52 on the pipe end. These structures hold the plug 44 tightly on the airpipe 36 and make it possible to insert the airpipe 36 in the furnace 1 horizontally.

Figure 6:
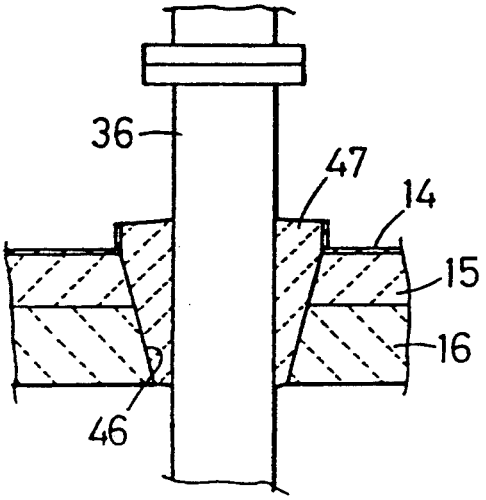
FIG. 6 is a sectional view showing another embodiment of the seal structure of the airpipe.

FIG. 6 shows another embodiment of the seal member 47. In this case, the attaching hole 46 is tapered off to the bottom. The attaching hole 46 can also be a step structure.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An incinerator having a furnace for incinerating refuse, an exhauster for drawing out waste gas from the furnace and a device for supplying air into the furnace, the furnace comprising:

a first block for adding refuse into the furnace through an access port closed by an access door;

a second block for leading combustion gas to the exhauster through a flue hole;

a third block inserted between the first and the second block according to the required furnace capacity;

a first airpipe for blowing combustion air into the first block from an air supplying device, and a second airpipe for blowing combustion air into the second block from an air supplying device, wherein the airpipes include respective straight pipe sections protruding into the respective blocks and having a plurality of injection holes around their pipe surface and a plug of castable refractory material filled up in an end of the pipe for closing an opening in the end of the pipe.

2. An incinerator according to claim 1, wherein each of the blocks has a steel external wall, a heat resisting and insulating layer lined on the external wall and a refractory layer coated on the inmost portion of the wall, a hole on the furnace wall for inserting the airpipe into the furnace inside, and a castable and easy spallable refractory member for filling up a gap between the hole and the airpipe.

3. An incinerator according to claim 1, wherein the exhauster has a dust collector connected to the second block of the furnace, a chimney for drawing out exhaust gas, and an air ejector placed between the dust collector and the chimney, the air supplying device having a blast fan for providing air to the airpipe through a damper of a blast path connected to the fan and a branch pipe separated from the damper and extended into the air ejector, the damper distributing combustion air to the branch pipe prior to opening the access port.

4. An incinerator according to claim 2, wherein the exhauster has a dust collector connected to the second block of the furnace, a chimney for drawing out exhaust gas, and an air ejector placed between the dust collector and the chimney, and the air supplying device having a blast fan for providing air to the airpipe through a damper of a blast path connected to the fan and a branch pipe separated from the damper and extended into the air ejector, the damper distributing combustion air to the branch pipe prior to opening the access port.

5. An incinerator according to claim 1, wherein said airpipes are stainless steel.

6. An incinerator according to claim 2, wherein said airpipes are stainless steel.

7. An incinerator according to claim 3, wherein said airpipes are stainless steel.

8. An incinerator according to claim 4, wherein said airpipes are stainless steel.

9. An incinerator according to claim 1, wherein said airpipes are straight.

10. An incinerator according to claim 4, wherein said airpipes are straight.

11. An incinerator according to claim 5, wherein said airpipes are straight.

12. An incinerator according to claim 8, wherein said airpipes are straight.

* * * * *